United States Patent [19]

MacKenzie et al.

[11] Patent Number: 4,474,580

[45] Date of Patent: Oct. 2, 1984

[54] COMBUSTION FUEL ADDITIVES COMPRISING METAL ENOLATES

[75] Inventors: Ian M. MacKenzie, St. James; Alfred M. Vogel, Malverne; Joan Heiser, Bayport; Kenneth W. Bowers, Islip; Mark Driscoll, N. Massapequa; Angela M. Arettines, E. Northport, all of N.Y.

[73] Assignee: MacKenzie Chemical Works, Inc., Central Islip, N.Y.

[21] Appl. No.: 358,881

[22] Filed: Mar. 16, 1982

[51] Int. Cl.[3] ..... C10L 1/18

[52] U.S. Cl. ..... 44/68; 260/429 J; 260/429.2; 44/4

[58] Field of Search ..... 44/68, 4; 260/429 J, 260/429.2

[56] References Cited

U.S. PATENT DOCUMENTS

| | | | |
|---|---|---|---|
| 2,151,432 | 3/1939 | Lyons et al. | 44/68 |
| 3,003,859 | 10/1961 | Irish et al. | 44/68 |
| 3,389,978 | 6/1968 | Mann et al. | 44/68 |
| 3,558,440 | 1/1971 | Harris et al. | 260/429.2 |
| 3,794,473 | 2/1974 | Eisentraut et al. | 44/68 |
| 3,884,950 | 5/1975 | Koda et al. | 260/429.2 |
| 4,036,605 | 7/1977 | Hartle | 44/68 |
| 4,251,233 | 2/1981 | Sievers | 44/68 |

FOREIGN PATENT DOCUMENTS

| | | |
|---|---|---|
| 219071 | 12/1958 | Australia . |
| 219409 | 3/1960 | Australia . |

OTHER PUBLICATIONS

"Annals of the New York Academy of Science", 519–525, (1957).

Chemical Abstracts, 55 9856D, (1961).

Air Force Publication ARL TR 74–0170, (1974), pp. 27, 52 and 53.

*Primary Examiner*—Charles F. Warren

*Assistant Examiner*—Y. Harris-Smith

[57] ABSTRACT

An additive suitable for use in a combustion fuel comprising:

(a) a complex of an iron enolate having the formula:

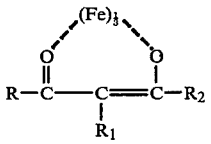

wherein R, $R_1$ and $R_2$ are, individually, hydrogen, alkyl having 1 to 22 carbon atoms or aryl in an amount effective to improve the combustion performance of the combustion fuel and, per part by weight of iron enolate;

(b) 0.05 to 10 parts of a cerium enolate having the formula:

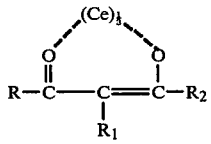

wherein R, $R_1$ and $R_2$ are, individually, hydrogen, alkyl having 1 to 22 carbon atoms or aryl; and (c) 5 to 150 parts of a solvent capable of rendering the iron enolate and the cerium enolate miscible with the combustion fuel.

33 Claims, No Drawings

COMBUSTION FUEL ADDITIVES COMPRISING METAL ENOLATES

BACKGROUND OF THE INVENTION

The present invention is directed to combustion fuel additives and more particularly to additives for kerosene, diesel fuel, gasoline, high pressure steam boiler fuel such as No. 6 fuel, low pressure steam boiler fuel such as No. 2 or No. 4 fuel, and coal.

It is well known to combine combustion fuels with various additives in order to improve the combustion performance of the fuel. For example, H. Lamprey discloses in "Annals of the New York Academy of Science", 519 (1957) at page 22 that metal acetylacetonates catalyze combustion, prevent sludge and hard carbon deposits and act as soot-removal agents when used in lubricating and fuel oils. Similarly, Australia Patent No. 219,409 discloses at column 2 that acetylacetone compounds of iron or other transition metals of the iron group reduce smoking and carbon deposition and improve anti-knock properties of hydrocarbon fuels; see "Chemical Abstracts" 55 9856D (1961). Other metal complexes of enol forms of beta-dicarbonyl compounds are also known in fuel additive applications as well as in other applications. For example, cerium tri-1,1,1,5,5,5-hexafluoropentane-2,4-dionate and cerium tri-2,2,6,6-tetramethylheptane-3,5-dionate have been used in fuel additives.

The metal enolates of enolizable beta-dicarbonyl compounds useful in fuel additives as well as in other applications are usually metal acetylacetonates, which have the following formula:

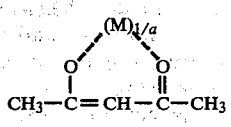

wherein a is the valence of the metal.

The enol forms of other beta-dicarbonyl compounds are also known as chelating agents for metals. For example, in addition to the cerium complexes shown above, benzoyl acetone and formylacetone have been used to form metal complexes. Moreover, one or both of the carbonyl groups may be part of a ring. For example, 2-ketocyclopentanecarboxylic acid esters have been used as complexing agents for metals.

In these metal complexes, it is generally thought that the metal is the more active component. The organic chelating group aids in rendering the metal soluble in the medium in which it is used.

Other ingredients besides metal enolates have also been used as combustion fuel additives. For example, picric acid and tricresyl phosphate have been used for this purpose. The formulation of combustion fuel additives, however, is more an art than a science. It is generally difficult to predict the effect of a particular additive. Thus, most additives are formulated on the basis of trial and error.

Additives have been used in a variety combustion fuels. For example, kerosene heaters have recently become increasingly popular in the United States. Additives are needed to improve the combustion performance of kerosene, to reduce the build-up of gums on the wicks of such heaters, and to reduce the amount of soot given off during their use.

Additives are also needed in motor fuels. In addition to improving the octane rating of motor fuels, it is important for an additive to be able to reduce the amount of particulates which are given off during the combustion of many motor fuels.

Additives are also needed in high pressure steam boiler fuels such as No. 6 fuel. One problem with the use of No. 6 fuel is that slag tends to condense on the tubes of high pressure steam boilers. Slag is generally thought to be a residue of the distillation process and to contain salts such as sodium silicate, sodium aluminum silicate, and various vanadate salts. The build-up of slag adds thickness to the tubes and prevents heat transfer from hot gases to the boiler tubes. In view of these problems, it is important that high pressure steam boiler fuel additives reduce slag.

In view of the increasing cost of combustion fuels and of the increasing pollution problems caused by the combusting of fuels, a need continues to exist for improved combustion fuel additives which give superior combustion performance as well as eliminate the various problems which arise during the combustion of different types of fuels in their various applications.

OBJECTS OF THE INVENTION

It is an object of the present invention to provide a combustion fuel additive which provides superior combustion performance when combined with a combustion fuel. It is a further object of the present invention to provide a combustion fuel additive helpful in overcoming the specific problems which arise during the combustion of kerosene, gasoline, diesel fuel, fuel oils for high pressure and low pressure steam boilers, and coal.

SUMMARY OF THE INVENTION

These and other objects of the present invention which will become apparent from the discussion below have been attained by providing combustion fuel additives comprising:

(a) a complex of an iron enolate having the formula:

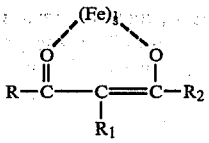

wherein R, $R_1$ and $R_2$ are, individually, hydrogen, alkyl having 1 to 22 carbon atoms or aryl in an amount effective to improve the combustion performance of the combustion fuel and, per part by weight of iron enolate;

(b) 0.05 to 10 parts of a cerium enolate having the formula:

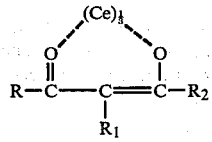

wherein R, $R_1$ and $R_2$ are, individually, hydrogen, alkyl having 1 to 22 carbon atoms or aryl; and (c) 5 to 150 parts of a solvent capable of rendering the iron enolate and the cerium enolate miscible with the combustion fuel.

The objects of this invention are also attained by a combustion fuel additive comprising:

(a) hydrated cerium acetylacetonate in an amount effective to improve the combustion performance of the combustion fuel; and (b) methyl alcohol and isopropyl alcohol in a ratio of 3:7 to 3:2 in an amount effective to render the hydrated cerium acetylacetonate miscible in the combustion fuel.

DETAILED DESCRIPTION OF THE INVENTION

The presently claimed combustion fuel additive contains a complex of iron and an enolate of an enolizable beta-dicarbonyl compound; a complex of cerium and an enolate of an enolizable beta-dicarbonyl compound; and a solvent. The enolizable beta-dicarbonyl compound has the general formula:

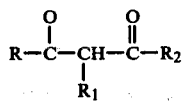

wherein R, $R_1$ and $R_2$ are, individually, hydrogen, alkyl or aryl. R, $R_1$ and $R_2$ may either be the same or may be different groups. Suitable alkyl groups generally contain less than about 22 carbon atoms, preferably 1 to 4 carbon atoms and most preferably 1 carbon atom. The alkyl groups may be straight chain groups or may be branched with other alkyl groups such as methyl or ethyl, or with aryl groups such as phenyl groups. For the purposes of the present specification and claims, the term "alkyl" refers to alkyl groups substituted with, besides hydrogen, other atoms or groups such as halogen atoms, hydroxyl groups, amino groups, carbonyl groups, or acyloxy groups. Some alkyl groups suitable for use in the formula given above as R, $R_1$, and $R_2$ include methyl, ethyl, propyl, isopropyl, isobutyl, isooctyl, dodecyl and octydecyl. Some suitable aryl groups include phenyl, ortho, meta or para chlorophenol, ortho, meta or para bromophenol, ortho, meta or para tolyl, and ortho, meta or para hydroxy phenol.

The definition of "alkyl" in the present specification and claims also encompasses the situation in which two of the three R groups are joined so as to form a cyclic compound. Formulas for the cyclic compounds may be represented as follows:

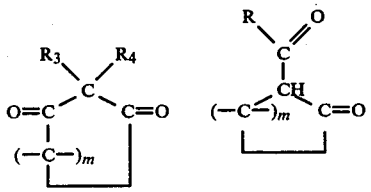

In these formulas, m may be an integer from 3 to 20 and n may be an integer from 1 to 20, preferably 4 to 7 and most preferably 4. $R_3$ and $R_4$ are the same as R, $R_1$ and $R_2$ as defined above except at least one of $R_3$ and $R_4$ is hydrogen. The ringed compounds may contain carbon atoms, represented (—C—) in the formulas, which are fully unsaturated, fully saturated or partially unsaturated. Some suitable enolates include acetylacetonate, formylacetonate, benzoylacetonate, the anion of salicylaldehyde, the anion of 2-hydroxyacetophenone, 2-formylcyclohexanonate, and the like. Acetylacetonate and salicylaldehyde are the preferred enolates. Acetylacetonate is particularly preferred.

Although cerium enolates and iron enolates have been added separately to combustion fuels in the past, it has now unexpectedly been found that combustion fuel additives containing both a cerium enolate and an iron enolate are superior to additives which contain either a cerium enolate or an iron enolate separately. This synergistic effect leads to an improvement in combustion performance as well as in other combustion fuel additive properties as discussed below.

A solvent is added to the present additives in order to render the metal enolates soluble in the combustion fuel. Some suitable solvents include alcohols, chlorinated solvents, acyclic ethers, cyclic ethers such as 1,3-dioxacyclopentane and dioxane, and ketones such as acetone, methylethylketone, and cyclohexanone.

Alcohols having 1 to 6 carbon atoms are preferred solvents. Suitable alcohols include methanol, ethanol, n-propanol, isopropanol, n-butyl alcohol, isobutyl alcohol, tertiary butyl alcohol, amyl alcohols such as n-amyl, isoamyl, and tert-amyl alcohol and hexyl alcohols, such as n-hexyl and isohexyl alcohols.

When used by itself, methyl alcohol is not miscible with kerosene or most other fuel oils. Therefore, when methyl alcohol is used as a solvent, another alcohol having more than two carbon atoms, preferably 3 to 6 carbon atoms and most preferably isopropyl alcohol, is also present in an amount which renders the methyl alcohol miscible in hydrocarbons.

The type of solvent used depends in part upon the nature of the cerium complex. When cerium complexes are made in the usual way, i.e., under aqueous conditions, they are yellow, have a melting point of 139° to 149° C., and are believed to be hydrated. Upon heating the hydrated form of cerium enolate, the enolate becomes red and decomposes before melting. It is believed that the hydrated form of cerium enolate loses about 3 to 4 molecules of water per molecule of enolate upon heating. This red form of enolate will be referred to in the application as dehydrated cerium enolate. Some suitable conditions for converting the hydrated form of cerium enolate to the dehydrated form include heating at 60° C. under a vacuum of 20 to 25 inches of mercury, or heating the cerium enolate in an alcohol. Suitable alcohols include methyl alcohol, ethyl alcohol, isopropyl alcohol, n-propyl alcohol or an alcohol having more than 3 carbon atoms such as a butyl alcohol, an amyl alcohol, or a hexyl alcohol.

In order to dissolve the hydrated form of cerium enolate in an alcohol solvent, methanol must be present in order to dissolve the cerium enolate and a second alcohol having more than 2 carbon atoms must be present in order to render the methanol miscible in the hydrocarbon fuel.

More particularly, it has unexpectedly been found that the various isomers of propyl, butyl, amyl and hexyl alcohols in combination with methyl alcohol in proportions of 3:7 to 3:2 render hydrated cerium acetylacetonate soluble in combustion fuels at the levels presently claimed. Other alcohols, such as ethanol, when used by itself or in combination with higher alcohols, however, do not render enough cerium acetylacetonate soluble in most combustion fuels to be useful. Therefore, when the hydrated acetylacetonate complex of cerium is present in the additive, a mixture of methyl alcohol and another alcohol having more than 2 carbon atoms, preferably 3 to 6 carbon atoms, and most preferably isopropyl alcohol in ratios of 3:7 to 3:2 is the preferred solvent. Preferred ratios of methyl alcohol and alcohol having more than 2 carbon atoms are 1:2 to 1:1. An especially preferred ratio is 2:3.

Chlorinated hydrocarbons such as mono- and polychlorinated alkanes and alkenes as well as mono- and polychlorinated benzenes and substituted benzenes also render cerium enolates soluble in combustion fuels, although more slowly than mixtures of methyl alcohol and propyl, butyl, amyl, and hexyl alcohols. Some suitable chlorinated alkanes and alkenes include methylene chloride, perchloroethylene, and trichloropropane. Some suitable chlorobenzenes and substituted benzenes include chlorobenzene; ortho-, meta-, and para-dichlorobenzene; ortho-, meta-, and para-chlorotoluene; and chloroxylene.

Chlorinated hydrocarbons are especially useful in rendering cerium acetylacetonate soluble in high pressure steam boiler fuels. In addition to its solubility characteristics, chlorinated hydrocarbons reduce slag during the combustion of such fuels. Therefore, chlorinated hydrocarbons are the preferred solvents for high pressure steam boiler fuel additives.

Although chlorinated hydrocarbons are useful in additives other than high pressure steam boiler fuel additives, they tend to resist combustion and to solubilize cerium acetylacetonate more slowly than alcohols. Therefore, chlorinated hydrocarbons are generally less preferable than the alcohol solvents. Chlorinated hydrocarbons may be used in pure form, but for economic reasons, are generally mixtures of chlorinated hydrocarbons. Such mixtures are often by-products of industrial processes.

It has also unexpectedly been found that the dehydrated form of cerium enolate is soluble in hydrocarbons such as hydrocarbon fuels in the absence of suitable solvents such as the alcohols and chlorinated hydrocarbons described above. If the cerium enolate is dehydrated by heating in any alcohol having more than 2 carbon atoms, the cerium enolate may be introduced into the hydrocarbon fuel with the alcohol in the absence of methanol and/or ethanol, both of which are immiscible in hydrocarbon fuels. If the cerium enolate is prepared by heating under vaccum or if it is prepared by heating in an alcohol and isolated from the alcohol, the cerium enolate may be introduced into a hydrocarbon fuel in the absence of alcohols, chlorinated hydrocarbons, or other solvents capable of rendering the hydrated form miscible in hydrocarbons. For economic and other reasons, it is advantageous to omit methanol from the alcohol solvent or the alcohol solvent entirely, where possible.

In addition to those listed above, other ingredients may be added to the presently claimed compositions. For example, it is customary to include an amount of the same combustion fuel to which the additive is to be introduced. Thus, an additive for kerosene will generally contain kerosene and an additive for diesel fuel will generally contain diesel fuel. The combustion fuel present in the additive need not be the same as the combustion fuel to which the additive is introduced. Thus, kerosene may be present in an additive which is to be added to diesel fuel. In fact, it is sometimes desirable to do so.

The ranges of the components of the presently claimed additive will be discussed in terms of their parts by weight per part of iron enolate unless otherwise indicated. The amount of iron enolate in the combustion fuel is that amount which significantly improves the combustion properties of the fuel. The proportion of iron enolate is generally 0.000005 to 0.05% by weight of the combustion fuel, preferably 0.00001 to 0.03% by weight of the combustion fuel, and most preferably 0.00003 to 0.02% by weight of the combustion fuel.

The amount of iron enolate in the additive composition can be calculated from the amount of the total additive composition which will be introduced into the combustion fuel and the extent to which the ingredients in the additive will be diluted. The desired dilution of the additive normally depends upon such practical factors as convenience of shipping, handling, and manufacturing as well as cost. Generally, the iron complex will be present in the additive in an amount of 0.5 to 6.0% by weight.

The cerium enolate will be present in the additive and in the combustion fuel in an amount effective to improve the combustion properties of a fuel. Generally, the amount of cerium enolate is about 0.05 to 10 parts by weight per part of iron enolate. Preferably, the cerium enolate is present in an amount of 0.1 to 7 parts by weight and most preferably 0.15 to 5 parts by weight per part of the iron enolate.

The solvent will be present in the additive at least to the extent necessary to render the metal enolates miscible with the combustion fuel to which the additive is to be introduced. The solvent will generally be present in an amount of 5 to 150 parts by weight, preferably 10 to 100 parts by weight and most preferably 20 to 80 parts by weight per part of iron enolate.

When present, the combustible hydrocarbon is present in the fuel additive in an amount between about 50 and 4000 parts by weight of iron enolate, preferably 75 to 2000 parts, and most preferably 150 to 1700 parts. When dehydrated cerium enolate is present in the additive instead of the hydrated enolate, the hydrocarbon may, and is sometimes preferably, the only solvent in the additive.

The following discussion includes a description of some specific fuel additives. The specific fuel additives contain the ingredients and amounts disclosed above unless otherwise indicated.

The kerosene useful in kerosene heaters is an example of a combustion fuel which benefits from the present additives. The kerosene in the presence of the present additives burn more efficiently. Moreover, the gums which otherwise build-up on the wick and the soot which is given off by the burning kerosene are reduced.

Since kerosene heaters are consumer products, it is important that ingredients present in the additive not be difficult to handle or to give off harmful fumes. Therefore, it is preferable that additives to be used in kerosene heaters not contain picric acid or chlorinated hydrocarbons.

For introduction into diesel fuels, an additive preferably contains dimethylformamide and/or tricresyl phosphate in addition to the cerium and iron enolates. The amount of dimethylformamide used is 0.5 to 20 parts by weight per part by weight of the iron enolate, preferably 1 to 10 parts by weight and most preferably 3 to 7 parts by weight.

The amount of tricresyl phosphate useful in diesel fuel additives is 0.25 to 20 parts weight per part by weight of the iron enolate, preferably 0.4 to 11 parts by weight and most preferably 1 to 4 parts by weight.

Without being restricted by theory, it is believed that dimethylformamide suppresses the formation of particulates and catalyzes the oxidation of those particulates which do form. Tricresyl phosphate is believed advantageous because it improves the atomization of the fuel in the combustion chamber.

Diesel fuel additives optionally contain a combustible hydrocarbon. The combustible hydrocarbon will generally be diesel fuel, although other combustible hydrocarbons such as kerosene and gasoline are also useful. The amount of combustible hydrocarbon is 50 to 4000 parts by weight of iron enolate, preferably 75 to 2000 parts, and most preferably 150 to 1700 parts.

Solvents suitable for use in diesel fuel additives include alcohols, dioxane, and mixed chlorinated hydrocarbon solvents. The preferred solvents are alcohols. When hydrated cerium acetylacetonate is present in the additive, a mixture of methyl alochol and isopropyl alcohol in a ratio of 3:7 to 3:2 is especially preferable in order to render the complex soluble in the fuel.

Dimethylformamide and/or tricresyl phosphate is preferably present in gasoline additives in about the same amounts used in diesel fuels.

Gasoline additives may also optionally contain a combustible hydrocarbon. The preferred combustible hydrocarbon is gasoline although other combustible hydrocarbons such as kerosene and diesel fuel are also suitable. The amount of combustible hydrocarbon in gasoline additives is 50 to 4000 parts by weight per part by weight of the iron enolate, preferably 75 to 2000 parts and most preferably 150 to 1700 parts. It is preferable for safety reasons that there be no combustible hydrocarbon in gasoline additives.

The preferred solvents for gasoline additives are alcohols. When hydrated cerium acetylacetonate is present in the additive, a mixture of methyl alcohol and isopropyl alcohol in the ratio of 3:7 to 3:2 is preferred in order to render the complex soluble in the fuel.

The present additives are also useful for introduction into high pressure steam boilers, which generally burn No. 6 fuel oil. A serious problem with No. 6 fuel oil is the production of slag in the steam boiler. In order to reduce slag, the present additives preferably contain boric acid. The amount of boric acid is generally 0.01 to 0.25 parts by weight per part by weight of iron enolate, preferably 0.02 to 0.15 parts by weight and most preferably 0.04 to 0.1 parts by weight.

Additives for high pressure steam boiler fuel oils optionally contain a combustible hydrocarbon. The preferred combustible hydrocarbon is No. 2 or No. 4 fuel oil, although other combustible hydrocarbons are also suitable. The amount of combustible hydrocarbon is generally 55 to 125 parts by weight of iron enolate, preferably 60 to 100 parts and most preferably 70 to 90 parts.

The solvent for additives useful in high pressure steam boiler fuel oil systems include alcohols, dioxane, and chlorinated hydrocarbons. The preferred solvents are chlorinated hydrocarbons since chlorinated hydrocarbons reduce slag.

Coal additives are similar to high pressure steam boiler fuel oil additives except the amount of chlorinated hydrocarbons is somewhat higher in the coal additives. The amount of chlorinated hydrocarbon present in a coal additive is 50 to 250 parts, preferably 70 to 160 parts and most preferably 80 to 120 parts by weight per part by weight of iron enolate.

Additives for low pressure steam boiler fuel oils are also similar to those for higher pressure steam boiler fuel oils. Low pressure steam boilers generally burn No. 2 or No. 4 fuel oil. No. 2 and No. 4 fuel oils do not give rise to slag formation in significant amounts. Therefore, the use of boric acid is not necessary and low pressure steam boiler fuel oil additives preferably do not contain significant amounts of boric acid.

Low pressure steam boiler fuel oil additives optionally contain a combustible hydrocarbon in amounts of 50 to 150 parts per part by weight of iron enolate. The preferred amount is 70 to 125 parts by weight and the most preferred amount is 85 to 110 parts by weight. The preferred combustible fuel is No. 2 or No. 4 fuel oil.

Solvents suitable for use in low pressure steam boiler fuel additives include alcohols, dioxane and chlorinated solvents. The preferred solvents for low pressure steam boiler fuel oil additives are alcohols. When hydrated cerium acetylacetonate is present in the additive, a mixture of methyl alcohol and isopropyl alcohol or butyl, amyl and hexyl alcohols is preferred in order to render the complex soluble in the fuel. A mixture of methyl alcohol and isopropyl alcohol in a ratio of 3:7 to 3:2 is especially preferable. Anhydrous cerium acetylacetonate is soluble in hydrocarbons in the absence of alcohols.

The metal enolates of the present invention may be prepared by well known techniques. Generally, a salt containing the desired metal and the desired beta-dicarbonyl compound are dissolved in a suitable solvent. A base such as ammonium is added to raise the pH to a level at which the metal enolate precipitates from solution. The solvent used in this process is generally an aqueous solvent. Metal enolates are also commercially available from the MacKenzie Chemical Works, Inc.

Having generally described the invention, a more complete understanding can be obtained by reference to certain specific examples, which are provided herein for purposes of illustration only. It is not intended that these examples limit the claimed invention unless otherwise specified.

EXAMPLE I

Kerosene Additive a.
16 grams Cerium triacetylacetonate
4 grams Iron triacetylacetonate
500 ml Methyl Alcohol
800 ml Isopropyl Alcohol
2500 ml Kerosene b.
16 grams Cerium triacetylacetonate
4 grams Iron triacetylacetonate
800 ml Isopropyl Alcohol
3000 ml Kerosene c.
16 grams Cerium triacetylacetonate
4 grams Iron triacetylacetonate
800 ml N-butanol
3500 ml Kerosene

EXAMPLE 2

High Pressure Steam Boiler Fuel Oil Additive a.
100 gal. Isopropyl Alcohol 12 gal. Methyl Alcohol
6 # Boric Acid
12 # Tricresyl phosphate
26 gal. mix Chlorinated solvent
32 # Ferric Triacetylacetonate
16 # Cerium Triacetylacetonate
Sufficient #2 fuel oil to make 550 gal.

b.
100 gal. N-butanol
12 gal. Methyl Alcohol
6 # Boric Acid
12 # Tricresyl phosphate
26 gal. Mixed Chlorinated solvent
32 # Ferric Triacetylacetonate
16 # Cerium Triacetylacetonate
Sufficient #2 fuel oil to make 550 gal.
A high pressure steam boiler fuel oil additive
400 gallons fuel oil
6 pounds boric acid
12 pounds tricresyl phosphate
26 gallons mixed chlorinated solvent
32 pounds iron triacetylacetonate
16 pounds cerium triacetylacetonate
100 gallons isopropyl alcohol
12 gallons methyl alcohol

EXAMPLE 3

Diesel Fuel Additive a.
2 # Cerium Triacetylacetonate
4 gal. N-butanol
4 # Iron acetylacetonate
10 # Tricresyl phosphate
20 # Di Methyl formamide
8 # Nonesol
30 # Chlorinated solvent (mixed)
Diluted with diesel fuel or #2 fuel oil to make 550 gallons.

EXAMPLE 4

LOW PRESSURE STEAM BOILER FUEL OIL ADDITIVE a.
55 gal. IPA
30 gal. Mixed Chlorinated solvent
30 # Ferric Acetylacetonate
5 # Cerium Triacetylacetonate
12 # Tricresyl phosphate
1 # Boric Acid
Sufficient #2 fuel oil to make 550 gallons.

EXAMPLE 5

Gasoline Additive a.
16 # Cerium Triacetylacetonate
3.2 # Di Methyl formamide
100 gal. Methyl Alcohol
280 gal. Isopropyl Alcohol
1840 gal. Kerosene or #2 fuel oil b.
16 # Cerium Triacetylacetonate
80 gal. N-butanol
3.2 # Di Methyl formamide
2300 gal. Kerosene or fuel oil c.
12 # Cerium Triacetylacetonate
4 # Iron Triacetylacetonate
3.2 # Methyl formamide
180 gal. Methyl Alcohol
280 gal. Isopropyl Alcohol
1840 gal. Kerosene or fuel oil d.
12 # Cerium triacetylacetonate
4 # Iron Triacetylacetonate
80 gal. N-butanol
3.2 # Di methyl formamide
2200 gal. Kerosene or #2 fuel oil e.
12 # Cerium Triacetylacetonate
4 # Ferric Acetylacetonate
3.2 # Di Methyl formamide
80 gal. Isopropyl Alcohol
2200 gal. Kerosene or 190 2 fuel oil

EXAMPLE 6

Coal Additive a.
110 gal. Isopropyl Alcohol
110 gal. Mixed Chlorinated solvent
30 # Ferric Acetylacetonate
2 # Boric Acid
12 # Tricresyl phosphate
5 # Cerium (Acetylacetonate)$_3$
4 gal. Methyl Alcohol
400 gal. #2 fuel oil.

Having now fully described the invention, it will be apparent to one of ordinary skill in the art that many changes and modifications can be made thereto without departing from the spirit or scope of the invention as set forth herein.

What is claimed is:

1. An additive suitable for use in a combustion fuel comprising:

(a) a complex of an iron enolate having the formula:

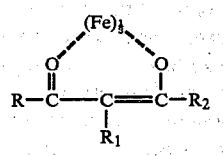

wherein R, $R_1$ and $R_2$ are, individually, hydrogen, alkyl having 1 to 22 carbon atoms or aryl in an amount effective to improve the combustion performance of the combustion fuel and, per part by weight of iron enolate;

(b) 0.05 to 10 parts of a cerium enolate having the formula:

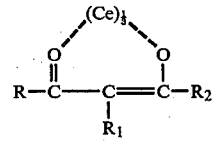

wherein R, $R_1$ and $R_2$ are, individually, hydrogen, alkyl having 1 to 22 carbon atoms or aryl; and (c) 5 to 150 parts of a solvent capable of rendering the iron enolate and the cerium enolate miscible with the combustion fuel.

2. An additive according to claim 1 wherein the parts by weight of the cerium complex is 0.1 to 7 and the parts by weight of the solvent is 10 to 100 parts by weight per part by weight of the iron enolate.

3. A combustion fuel additive according to claim 1 wherein the parts by weight of the cerium complex is 0.15 to 5 and the parts by weight of the solvent is 20 to 80 parts by weight of the iron enolate.

4. A combustion fuel additive according to claim 1 wherein the iron enolate is iron acetylacetonate.

5. A combustion fuel additive according to claim 1 wherein the iron enolate is a complex of iron and salicylaldehyde.

6. A combustion fuel additive according to claim 1 wherein the cerium enolate is cerium acetylacetonate.

7. A combustion fuel additive according to claim 1 wherein the cerium complex is a complex of cerium and salicylaldehyde.

8. A combustion fuel additive according to claim 1 wherein the solvent is an alcohol having 1 to 6 carbon atoms.

9. A combustion fuel additive according to claim 1 or 6 wherein the cerium enolate is hydrated and the solvent is a mixture of methyl alcohol and isopropyl alcohol in a ratio of 3:7 to 3:2.

10. A combustion fuel additive according to claim 1 wherein the solvent is a chlorinated hydrocarbon.

11. A kerosene additive according to claim 1 further comprising 50 to 4000 parts of a hydrocarbon fuel.

12. A kerosene additive according to claim 11 wherein the hydrocarbon fuel is kerosene.

13. A diesel or gasoline fuel additive according to claim 1 further comprising 0.5 to 20 parts by weight dimethylformamide and 0.25 to 20 parts tricresyl phosphate per part of iron enolate.

14. A diesel or gasoline fuel additive according to claim 13 further comprising 50 to 4000 parts by weight of a hydrocarbon fuel per part of iron enolate.

15. A diesel fuel additive according to claim 14 wherein the hydrocarbon fuel is diesel fuel.

16. A gasoline additive according to claim 14 wherein the hydrocarbon fuel is gasoline.

17. A high pressure steam boiler fuel additive suitable for use with No. 6 fuel according to claim 1 further comprising 0.01 to 0.25 parts boric acid per part of iron enolate.

18. A high pressure steam boiler fuel additive according to claim 17 wherein the solvent is an alcohol.

19. A high pressure steam boiler fuel additive according to claim 18 wherein the cerium enolate is hydrated cerium acetylacetonate and the alcohol comprises methyl alcohol and isopropyl alcohol in a ratio of 3:7 to 3:2.

20. A high pressure steam boiler additive according to claim 18 wherein the solvent comprises mixed chlorinated hydrocarbons.

21. A coal additive according to claim 17 or 20 wherein the amount of solvent is 50 to 250 parts by weight per part by weight of iron enolate.

22. A combustion fuel additive suitable for use in kerosene heaters comprising:

(a) a complex of an iron enolate having the formula:

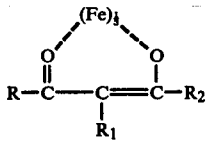

wherein R, $R_1$ and $R_2$ are, individually, hydrogen, alkyl or aryl in an amount effective to improve the combustion performance of the combustion fuel and, per part by weight of iron complex;

(b) 0.05 to 10 parts of cerium enolate having the formula:

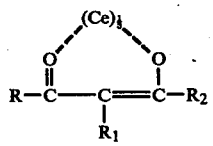

wherein R, $R_1$ and $R_2$ are, individually, hydrogen, alkyl or aryl;

(c) 50 to 4000 parts of kerosene; and (d) 5 to 150 parts of a mixture of methyl alcohol and isopropyl alcohol in a ratio of 3:7 to 3:2.

23. A combustion fuel additive suitable for use in diesel fuels comprising:

(a) a complex of an iron enolate having the formula:

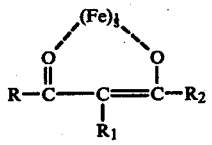

wherein R, $R_1$ and $R_2$ are, individually, hydrogen, alkyl or aryl in an amount effective to improve the combustion performance of the combustion fuel and, per part by weight of iron complex;

(b) 0.05 to 10 parts of a cerium enolate having the formula:

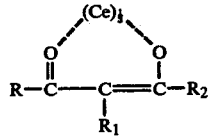

wherein R, $R_1$ and $R_2$ are, individually, hydrogen, alkyl or aryl; and (c) 0.5 to 20 parts by weight of dimethylformamide per part of iron enolate;

(d) 0.25 to 20 parts by weight of tricresyl phosphate per part of iron enolate;

(e) 5 to 150 parts by weight of a mixture of methyl alcohol and isopropyl alcohol in a ratio of 3:7 to 3:2, and (f) 50 to 4000 parts by weight of diesel fuel per part of iron enolate.

24. A combustion fuel additive suitable for use in gasoline comprising:

(a) a complex of an iron enolate having the formula:

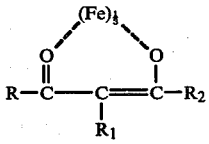

wherein R, $R_1$ and $R_2$ are, individually, hydrogen, alkyl or aryl in an amount effective to improve the combustion performance of the combustion fuel and, per part by weight of cerium complex; and (b) 5 to 150 parts of a mixture of methyl alcohol and isopropyl alcohol in a ratio of 3:7 to 3:2, and (c) 0.05 to 10 parts of cerium enolate having the formula:

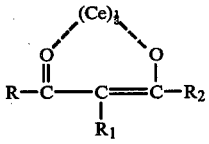

wherein R, $R_1$ and $R_2$ are, individually, hydrogen, alkyl or aryl.

25. A combution fuel additive suitable for use in high pressure steam boiler fuel oils comprising:

(a) a complex of an iron enolate having the formula:

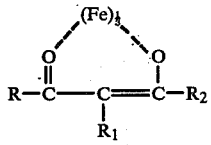

wherein R, $R_1$ and $R_2$ are, individually, hydrogen, alkyl or aryl in an amount effective to improve the combustion performance of the combustion fuel and, per part by weight of iron complex;

(b) 0.05 to 10 parts of a cerium enolate having the formula:

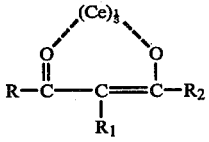

wherein R, $R_1$ and $R_2$ are, individually, hydrogen, alkyl or aryl; and (c) 5 to 150 parts by weight of a chlorinated hydrocarbon;

(d) 0.01 to 0.25 parts by weight of boric acid per part iron enolate;

(e) 55 to 125 parts by weight of No. 2 and No. 4 fuel oil per part by weight of iron enolate; and (f) 0.25 to 20 parts by weight of tricresyl phosphate per part by weight of iron enolate.

26. A combustion fuel additive suitable for use in coal burners comprising:

(a) a complex of an iron enolate having the formula:

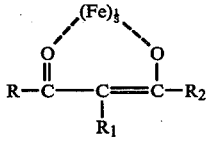

wherein R, $R_1$ and $R_2$ are, individually, hydrogen, alkyl or aryl in an amount effective to improve the combustion performance of the combustion fuel and, per part by weight of iron complex;

(b) 0.05 to 10 parts of a cerium enolate having the formula:

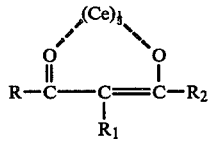

wherein R, $R_1$ and $R_2$ are, individually, hydrogen, alkyl or aryl; and (c) 20 to 80 parts by weight of a chlorinated hydrocarbon;

(d) 0.1 to 0.25 parts by weight of boric acid per part iron enolate;

(e) 55 to 125 parts by weight of No. 2 and No. 4 fuel oil per part by weight of iron enolate; and (f) 0.25 to 20 parts by weight of tricresyl phosphate per part by weight of iron enolate.

27. A combustion fuel additive suitable for use in low pressure steam boiler fuel oil comprising:

(a) a complex of an iron enolate having the formula:

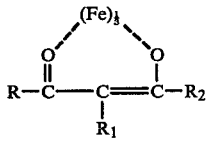

wherein R, $R_1$ and $R_2$ are, individually, hydrogen, alkyl or aryl and, per part by weight of iron complex;

(b) 0.05 to 10 parts of a cerium enolate having the formula:

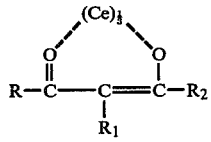

wherein R, $R_1$ and $R_2$ are, individually, hydrogen, alkyl or aryl; and (c) 5 to 150 parts by weight of a mixture of methyl alcohol and isopropyl alcohol in a ratio of 3:7 to 3:2; and (d) 0.25 to 20 parts by weight of tricresyl phosphate per part of iron enolate; and (e) 50 to 150 parts by weight of a low pressure steam boiler fuel oil.

28. A combustion fuel additive comprising:

(a) cerium acetylacetonate in an amount effective to improve the combustion performance of the combustion fuel; and (b) methyl alcohol and isopropyl alcohol in a ratio of 3:7 to 3:2 in an amount effective to render the cerium acetylacetonate miscible in the combustion fuel.

29. A combustion fuel containing the combustion fuel additive according to claim 1.

30. A combustion fuel according to claim 29 wherein the amount of iron enolate is 0.000005 to 0.05% by weight of the combustion fuel.

31. A combustion fuel according to claim 30 wherein the amount of iron enolate is 0.00001 to 0.03% by weight of the combustion fuel.

32. A combustion fuel according to claim 31 wherein the amount of iron enolate is 0.00003 to 0.02% by weight of the combustion fuel.

33. A combustion fuel containing the combustion fuel additive according to claim 28.

* * * * *